US005561500A

United States Patent [19]

Ohzeki et al.

[11] Patent Number: 5,561,500

[45] Date of Patent: Oct. 1, 1996

[54] IMAGE FORMING APPARATUS WITH PLURAL TYPES OF IMAGE FORMING DEVICES

[75] Inventors: Yukihiro Ohzeki, Yokohama; Katsuhiro Sakaizawa, Kawasaki; Kenya Ogawa, Yokohama, all of Japan

[73] Assignee: Canon Kabushiki Kaisha, Tokyo, Japan

[21] Appl. No.: 566,261

[22] Filed: Dec. 1, 1995

[30] Foreign Application Priority Data

Dec. 13, 1994 [JP] Japan ..... 6-332519

[51] Int. Cl.[6] ..... G03G 15/00

[52] U.S. Cl. ..... 355/202; 355/326; 347/43; 347/104

[58] Field of Search ..... 355/202, 200, 355/326 R, 327, 208; 347/171, 232, 115, 117, 118, 43

[56] References Cited

U.S. PATENT DOCUMENTS

| | | | |
|---|---|---|---|
| 5,198,858 | 3/1993 | Sugawa et al. | 355/202 |
| 5,321,467 | 6/1994 | Tanaka et al. | 355/202 |
| 5,373,350 | 12/1994 | Taylor et al. | 355/202 |

FOREIGN PATENT DOCUMENTS

| | | |
|---|---|---|
| 4294379 | 10/1992 | Japan . |
| 5006127 | 1/1993 | Japan . |
| 5134824 | 6/1993 | Japan . |

*Primary Examiner*—Arthur T. Grimley
*Assistant Examiner*—Quana Grainger
*Attorney, Agent, or Firm*—Fitzpatrick, Cella, Harper & Scinto

[57] ABSTRACT

An image forming apparatus for forming an image on a recording medium includes a first transporting path for transporting the recording medium for forming an image on the recording medium by using a first image forming unit, a second transporting path for transporting the recording medium for forming an image on the recording medium by using a second image forming unit which forms the image by an image forming method which is different from a method employed by the first image forming unit, and a controller for controlling the apparatus in a black image selection mode, in which the first transporting path is selected in accordance with black image data for forming a black image on the recording medium, and the recording medium is transported through the selected first transporting path to form a black image on the recording medium, a color image selection mode, in which the second transporting path is selected in accordance with image data including color image data for forming a color image on the recording medium and the recording medium is transported through the selected second transporting path to form a color image on the recording medium, and a forcible selection mode in which the first transporting path is selected even if the image data includes color image data to transport the recording medium through the selected first transporting path to form a black image on the recording medium.

36 Claims, 8 Drawing Sheets

| FIG. 4A | FIG. 4B |
|---|---|

| FIG. 6A | FIG. 6B |
|---|---|

IMAGE FORMING APPARATUS WITH PLURAL TYPES OF IMAGE FORMING DEVICES

BACKGROUND OF THE INVENTION

1. Field of the Invention

The present invention relates to a combined-type image forming apparatus having a plurality of image forming means according to different image forming methods.

2. Related Background Art

Image forming apparatuses for use in offices, in particular, copying machines, printers, and the like, must have reduced size and high speed operation and be capable of forming an image exhibiting excellent quality. In recent years, an apparatus capable forming a color image has been desired.

Image forming apparatuses usually employ an electrophotographic image forming method or an ink jet image forming method, each of which is a known image forming method. The electrophotographic image forming method is a method in which a toner image is formed on a photosensitive drum by a charging means, an exposing means and a developing means disposed adjacent to the photosensitive drum, and the toner image is transferred to a recording medium (hereinafter called as a "recording member") by a transferring means, and then the transferred image is fixed by a fixing means so that an image exhibiting excellent quality is formed at high speed. The ink jet image forming method is a method in which discharged liquid ink from a recording head is directly allowed to adhere to the surface of the recording medium to form an ink image. The ink jet image forming method is able to reduce the overall size of the apparatus.

To use the advantages of the foregoing two methods, an image forming apparatus comprising both an image forming means in accordance with the electrophotographic image forming method and an image forming means in accordance with the ink jet image forming method has been disclosed. See in particular Japanese Patent Laid-Open No. 4-294379, Japanese Patent Laid-Open No. 5-6127, Japanese Patent Laid-Open No. 5-134824 and so forth. The foregoing image forming apparatuses have the structure with which both methods are used in accordance with the purposes such that white and black images, which are used frequently in an office, are formed by the electrophotographic image forming method and color images, the frequency of use of which is low, are formed by the ink jet image forming method. Thus, an optimum image forming apparatus for the office can be provided. That is, the hybrid image forming apparatus formed by combining the two methods is able to reduce the overall size of the apparatus, form a white and black image exhibiting excellent quality at high speed and form a color image when required.

The present invention is an improvement in the conventional techniques.

SUMMARY OF THE INVENTION

An object of the present invention is to provide an image forming apparatus capable of using the advantages of the respective image forming methods.

Another object of the present invention is to provide an image forming apparatus capable of efficiently forming a black image and a color image.

Another object of the present invention is to provide an image forming apparatus capable of forming a black image and a color image both exhibiting excellent qualities.

Another object of the present invention is to provide an image forming apparatus capable of forming a black image at high speed and forming a color image with a compact apparatus.

Another object of the present invention is to provide an image forming apparatus including a first path formed from a feeding means to an image forming means in accordance with an electrophotographic image forming method and having an arrangement that if input image data is only white and black image data, then an image control means selects the first path.

Another object of the present invention is to provide an image forming apparatus having a structure such that a control means selects a first path if the input image data is black image data to enable a recording member to be directly transported to an electrophotographic image forming means without being allowed to pass through a color image forming means if only a black image is formed.

According to a first aspect of the present invention, an image forming apparatus for forming an image on a recording medium includes a first transporting path for transporting the recording medium for forming an image with first image forming means using a first image forming method, a second transporting path for transporting the recording medium for forming an image with second image forming means using a second image forming method which is different from the first image forming method, and control means for controlling the apparatus in at least one of a black image selection mode, in which the first transporting path is selected in accordance with black image data for forming a black image on the recording medium, and the recording medium is transported through the first transporting path to form a black image on the recording medium, a color image selection mode, in which the second transporting path is selected in accordance with image data including color image data for forming a color image on the recording medium and the recording medium is transported through the second transporting path to form a color image on the recording medium, and a forcible selection mode in which the first transporting path is selected even if the image data includes color image data to transport the recording medium through the first transporting path to form a black image on the recording medium.

According to another aspect of the present invention, an image forming apparatus for forming an image on a recording medium includes electrophotographic image forming means for forming an image on the recording medium in accordance with an electrophotographic image forming method, the electrophotographic image forming means forming a toner image on an electrophotographic photosensitive member and transferring the toner image to the recording medium to form the image on the recording medium, ink jet image forming means for forming an image on the recording medium in accordance with an ink jet image forming method, the ink jet image forming means forming the image on the recording medium by causing a nozzle to discharge liquid ink, a first transporting path for transporting the recording medium for forming the image on the recording medium by using the electrophotographic image forming means, a second transporting path for transporting the recording medium for forming the image on the recording medium by using the ink jet image forming means, control means for controlling the apparatus in at least one of a black image selection mode, in which the first transporting path is selected in accordance with black image data for forming a black image on the recording medium, and the recording medium is transported through the first transporting path to form a black image on the recording medium, a color image selection mode, in which the second transporting path is selected in accordance with image data including color image data for forming a color image on the recording medium and the recording medium is transported through the second transporting path to form a color image on the recording medium, and a forcible selection mode in which the first transporting path is selected even if the image data includes color image data to transport the recording medium through the first transporting path to form a black image on the recording medium, and setting means for automatically setting at least one of the black image selection mode and the color image selection mode in accordance with a result of discrimination as to whether supplied image data includes black image data or color image data, and setting the forcible selection mode when a forcible mode setting member is operated.

According to a further aspect of the present invention, an image forming apparatus for forming black images and color images on a recording medium includes electrophotographic image forming means for forming an image on the recording medium in accordance with an electrophotographic image forming method, the electrophotographic image forming means forming a toner image on an electrophotographic photosensitive member and transferring the toner image to the recording medium to form the image on the recording medium, ink jet image forming means for forming an image on the recording medium in accordance with an ink jet image forming method, the ink jet image forming means forming the image on the recording medium by causing a nozzle to discharge liquid ink, a first transporting path for transporting the recording medium for forming the image on the recording medium by using the electrophotographic image forming means, a second transporting path for transporting the recording medium for forming the image on the recording medium by using the ink jet image forming means, control means for controlling the apparatus in at least one of a black image selection mode, in which the first transporting path is selected in accordance with black image data for forming a black image on the recording medium, and the recording medium is transported through the first transporting path to form a black image on the recording medium, a color image selection mode, in which the second transporting path is selected in accordance with image data including color image data for forming a color image on the recording medium, and the recording medium is transported through the second transporting path and then transported through the first transporting path to form a color image on the recording medium, and a forcible selection mode in which the first transporting path is selected even if the image data includes color image data to transport the recording medium through the first transporting path to form a black image on the recording medium, data separation means for separating supplied image data into color image data and black image data, data discrimination means for discriminating whether or not color image data exists in the data separated by the data separation means, and setting means for automatically setting the black image selection mode and the color image selection mode in the control means in accordance with a result of the discrimination means as to whether the supplied image data includes black image data or color image data, and setting the forcible selection mode in the control means when a forcible mode setting member is operated.

According to yet another aspect of the present invention, an image forming apparatus for forming an image on a recording medium includes first image forming means for forming an image on the recording medium in accordance with a first image forming method, second image forming means for forming an image on the recording medium in accordance with a second image forming method, control means for controlling an image to be formed on the recording medium by the first image forming means when input image data is of a first type, controlling an image to be formed on the recording medium by the second image forming means when input image data is of a second type, and controlling an image to be formed on the recording medium by the first and second image forming means when input image data is of a mixed type including the first and second types, and override means for selectively causing the control means to control an image to be formed by the first image forming means regardless of whether the input image data is of the first, second or mixed type.

According to an even further aspect of the present invention, a method of forming an image on a recording medium includes the steps of providing a first image forming devices for forming an image on the recording medium according to a first image forming method and a second image forming device for forming an image on the recording medium according to a second image forming method, controlling an image to be formed on the recording medium by the first image forming device when input image data is of a first type, controlling an image to be formed on the recording medium by the second image forming device when input image data is of a second type, and controlling an image to be formed on the recording medium by the first and second image forming devices when input image data is of a mixed type including the first and second types, and selectively causing an image to be formed by the first image forming device regardless of whether the input image data is of the first, second or mixed type.

Other and further objects, features and advantages of the invention will be appear more fully from the following description.

DETAILED DESCRIPTION OF THE PREFERRED EMBODIMENTS

Figure 1:
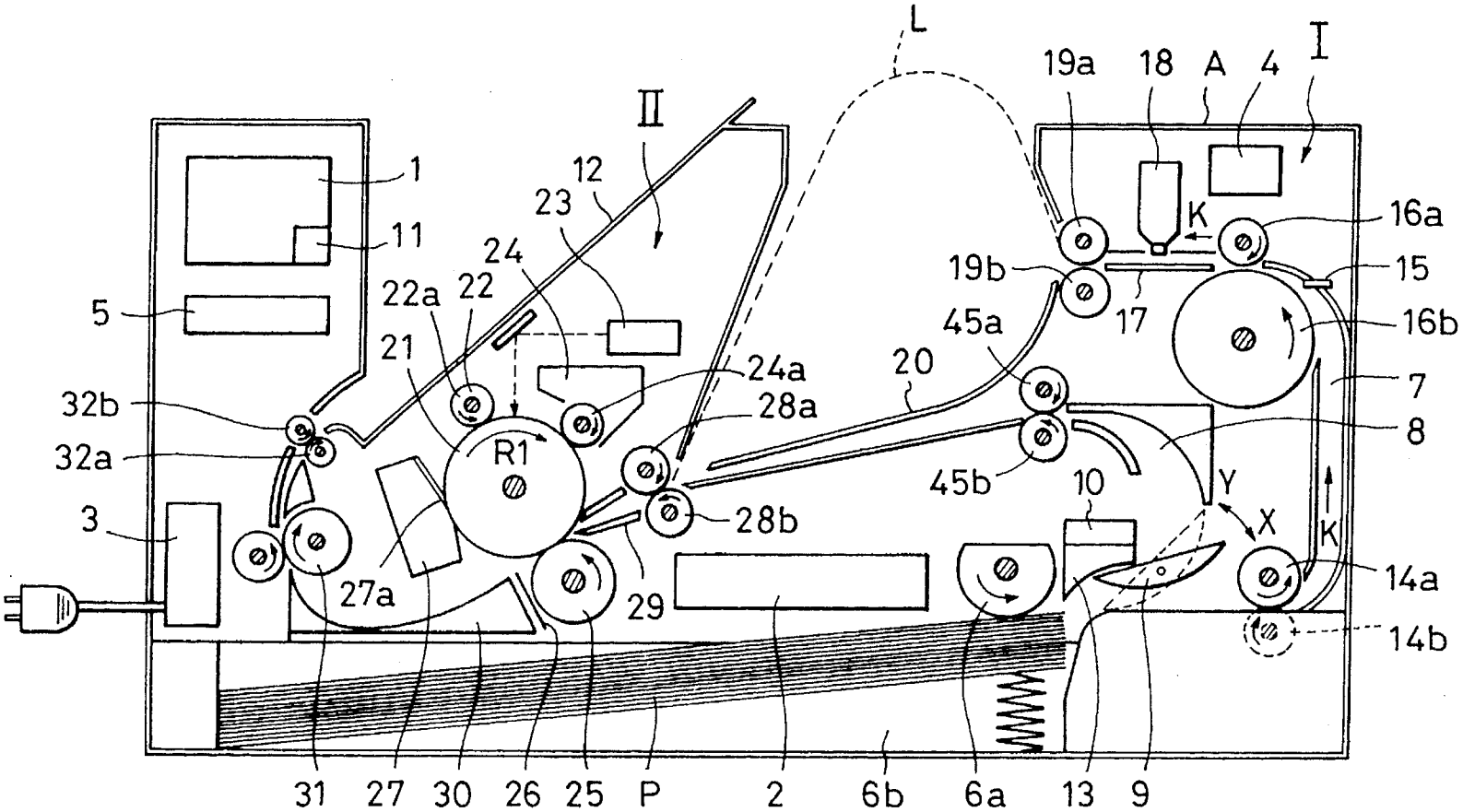
FIG. 1 is a cross sectional view showing a combined-type image forming apparatus according to a first embodiment of the present invention.

Referring to the drawings, preferred embodiments of a combined-type image forming apparatus according to the present invention will now be described. Elements having the same structures or functions are designated by the same reference numerals and will not be described repeatedly.

First Embodiment

Figure 2:
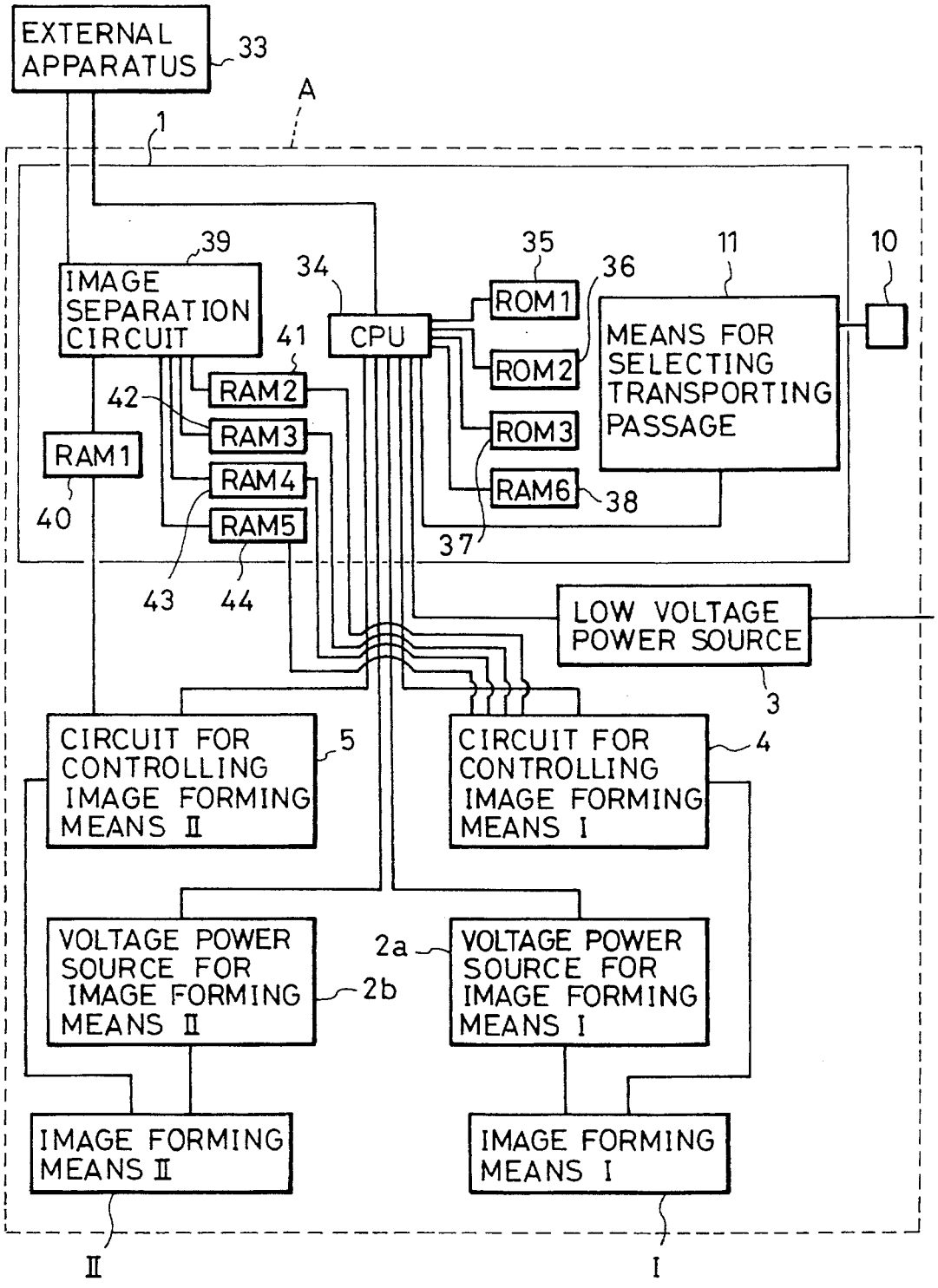
FIG. 2 is a schematic view showing a controller according to the first embodiment of the present invention.
Figure 3:
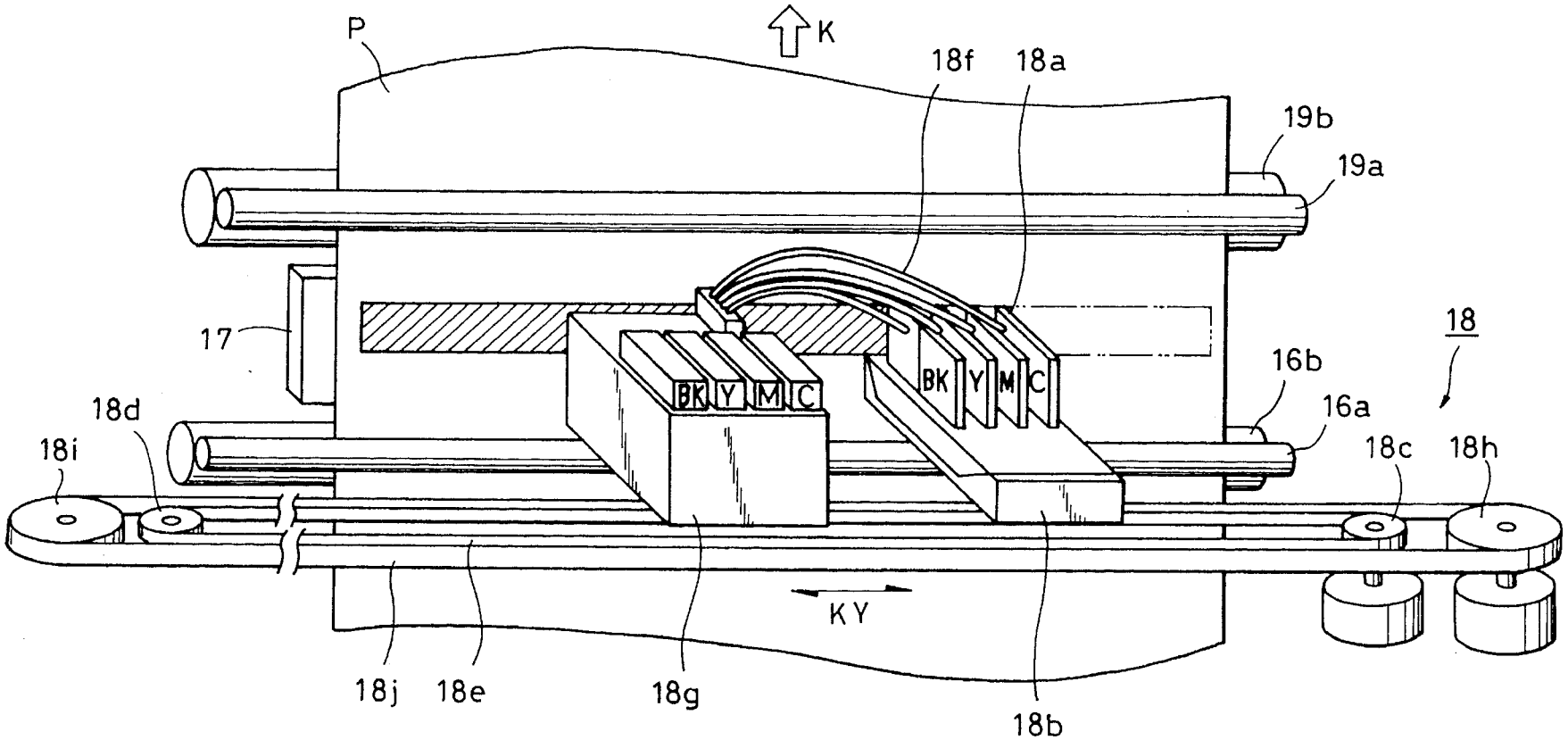
FIG. 3 is a schematic view showing a first image forming means according to the first embodiment of the present invention.

FIG. 1 is a schematic view showing the overall structure of the combined-type image forming apparatus according to a first embodiment of the present invention. FIG. 2 is a schematic view showing a controller for controlling the sequential operation of the combined-type image forming apparatus. FIG. 3 is a diagram showing an ink jet recording portion (an image forming means I). The confined-type image forming apparatus shown in FIG. 1 comprises a plurality of image forming means in accordance with different image forming methods each of which forms an image on a recording member (a recording medium) P due to sequential image forming processes thereof.

Initially, the schematic structure of a combined-type image forming apparatus A will now be described. The image forming apparatus comprises: a controller 1 for controlling the overall sequential operation of the image forming apparatus, a high-voltage power source 2 for controlling the overall high-voltage-level operation of the image forming apparatus and consisting of a voltage power source 2*a* for an image forming means I and a voltage power source 2*b* for an image forming means II, a low-voltage power source 3 for lowering the commercial voltage level for operating the controller 1, the high-voltage power source 2 and so forth, the image forming means I serving as a first image forming means in accordance with the ink jet method, the image forming means II serving as a second image forming means in accordance with the electrophotographic method, a control circuit 4 for controlling the operation of the image forming means I, a control circuit 5 for controlling the operation of the image forming means II, a sheet-feeding means 6 having sheet-feeding roller 6*a* and a sheet-feeding cassette 6*b* for feeding the recording sheet P, a sheet transporting path 7 serving as a first transporting path, a sheet transporting path 8 serving as a second transporting path, a flapper 9 for selecting the sheet transporting path 7 or the sheet transporting path 8, a flapper control circuit 10 for controlling the operation of the flapper 9, a transporting path selection means 11 for controlling the flapper control circuit 10 in accordance with input image data to control the flapper 9 to select the transporting path 7 or 8, and a sheet discharge tray 12 to which the recording sheet P is discharged, on which an image has been formed.

The order of the image forming means I and the image forming means II is not limited to the foregoing order. As a matter of course, the foregoing order may be reversed. The overall structure of the combined-type image forming apparatus A will now be described schematically. If mixture data of a black image and a color image is supplied, a color ink image is formed by liquid inks for a plurality of colors on the recording sheet P, which is transported through the sheet transporting path 7, by the image forming means I (according to the ink jet image forming method) disposed in the upstream position, and a black toner image is formed by a developer (hereinafter called "toner") by the image forming means II (according to the electrophotographic image forming method) disposed in the downstream position. If data of only a black image has been input, only a black toner image is formed by the image forming means II on the recording sheet P which is transported through the sheet transporting path 8 without being allowed to pass through the image forming means I. The "color image" is an image in any color except black.

The structures of the image forming means I and the image forming means II will now be described in this order. Referring to FIGS. 1 and 3, the image forming means I comprises a transporting guide 13, the flapper 9, a pair of transporting rollers 14*a* and 14*b*, the sheet transporting path 7, a sheet detecting sensor 15, a pair of sheet transporting rollers 16*a* and 16*b*, a platen 17, an ink jet recording portion 18 and a pair of discharge rollers 19*a* and 19*b* which are disposed in the foregoing order from the sheet-feeding means 6 when viewed from an upstream position. A guide 20 is disposed between the image forming means I and the image forming means II, the guide 20 is capable of forming a loop L in the recording sheet P in order to accommodate a change in the transporting method from an incremental transporting method to a continuous transporting method.

The transporting rollers 14*a* and 14*b* continuously transport the recording sheet P, which has been fed from the sheet-feeding means 6, through the sheet transporting path 7 toward the transporting rollers 16*a* and 16*b* (as indicated by an arrow K). If the sheet detection sensor 15 detects the recording sheet P, the sheet transporting rollers 16*a* and 16*b* and the sheet transporting rollers 14*a* and 14*b* are rotated by a stepping motor (not shown) to intermittently transport the recording sheet P in association with one another.

The ink jet recording portion 18, as indicated in FIG. 3 (which is a perspective view viewed from a position substantially above FIG. 1), has a recording head (a recording means) 18*a*. The recording head 18*a* comprises cyan (C), magenta (M), yellow (Y) and black (BK) ink head units disposed in the lateral direction (indicated by an arrow KY). The recording head 18*a* is mounted on a carriage 18*b*. The carriage 18*b* can be moved precisely in the lateral direction (in the direction indicated by the arrow KY) by a guide (not shown) secured to a portion of an internal belt 18*e* arranged between a drive pulley 18*c* disposed at an inner right position and a follower pulley 18*d* disposed at an inner left position.

Four tubes 18*f* corresponding to the head units for the respective color inks are connected to the recording head 18*a* so that inks for the respective colors are supplied from an ink tank 18*g* for the respective colors through the corresponding tubes 18*f*. The ink tank 18*g* is secured to a portion of an outer belt 18*j* arranged between a drive pulley 18*h* disposed at an outer right position and a follower pulley 18*i* disposed at an outer left position. Thus, the ink tank 18*g* can be, similarly to the recording head 18*a*, moved in a direction indicated by an arrow KY along a guide (not shown).

Since the ink tank 18*g* can be moved laterally when the recording head 18*a* is moved laterally as described above, the stress acting on the tubes 18*f* can be reduced. Since the recording head 18*a* and the ink tank 18*g* are individually formed so as to be separately moved, propagation of vibrations and the like generated when the ink tank 18*g*, which is heavier than the recording head 18*a*, is moved can be prevented. Note that the specific structure of the recording head 18*a* will be described after a second embodiment is described.

The image forming means I for a color machine shown in FIG. 3 and that of a monotone machine (not shown) will now be described. Although the color image forming machine (a four-color image forming apparatus) shown in FIG. 3 requires four ink head units and four units of ink tank 18*g* for the respective colors, the monotone image forming machine requires only one head unit and one ink tank unit for one color.

The head for the four inks and the ink tank 18*g* for the four colors of the color image forming machine are disposed in a space, in which the carriage 18*b* and the ink tank 18*g* are moved, the space being substantially the same as that required for the monotone image forming apparatus. Therefore, enlargement of the size of the color image forming apparatus can be prevented.

As shown in FIG. 1, the image forming means II comprises a photosensitive-member drum 21 serving as an image carrier which is rotated in a direction indicated by an arrow R1. A charging means, an exposing means, a developing means, a transferring means, a charge-removing means and a cleaning means are, in a direction of rotation of the photosensitive-member drum 21, disposed in this sequential order around the photosensitive-member drum 21.

The foregoing means can include, for example, a charging unit 22 for uniformly charging the surface of the photosensitive-member drum 21 to a predetermined negative potential, a laser exposing unit 23, that is, a laser exposing unit 23 which irradiates the photosensitive-member drum 21 with a laser beam corresponding to image information to form an electrostatic latent image, a developing unit 24 for causing toner to adhere to the electrostatic latent image to inversely develop the image, a transferring roller 25 for transferring the toner image formed on the photosensitive-member drum 21 to the recording sheet P, a charge-removing needle 26 for removing the charge of the recording sheet P, to which the toner image has been transferred, and a cleaner 27 for removing the toner on the photosensitive-member drum 21 from which the toner image has been transferred. In this embodiment, the developing unit 24 comprises a developing roller 24*a* which is rotated so that the toner is supplied to the photosensitive-member drum 21. The charging unit 22 has a charging roller 22*a* which is rotated to follow the rotation of the photosensitive-member drum 21. The cleaner 27 comprises an elastic cleaning blade 27*a* which is in contact with the photosensitive-member drum 21 to remove the toner left on the photosensitive-member drum 21. Furthermore, a pair of resist rollers 28*a* and 28*b* are disposed to continuously supply and transport, to a position at which the photosensitive-member drum 21 and the transferring roller 25 are in contact with each other, either the recording sheet P, which has been incrementally transported from the image forming means I through the transporting guide 20, or the recording sheet P continuously and directly transported to the image forming means II through the sheet transporting path 8, the recording sheet P being transported as described above at a predetermined timing through a transferring inlet guide 29.

After the toner image has been transferred to the recording sheet P by the transferring roller 25, the recording sheet P is transported to a heat fixing device 31 through a transporting guide 30 so that the toner image is heated and pressed. Thus, the toner image is melted and coagulated so that it is fixed as a permanent image. The recording sheet P discharged from the heat fixing device 31 is discharged to the discharge tray 12 by sheet-discharge rollers 32*a* and 32*b*.

The controller 1 of the combined-type image forming apparatus A has a structure adaptable to a case where a printing signal and black/color image data have been supplied from an external apparatus 33, such as a computer, the structure being arranged in such a manner that the controller 1 supplies the printing signal and color image data to the image forming means I and supplies the printing signal and the black image data to the image forming means II.

Figures 4, 4A:
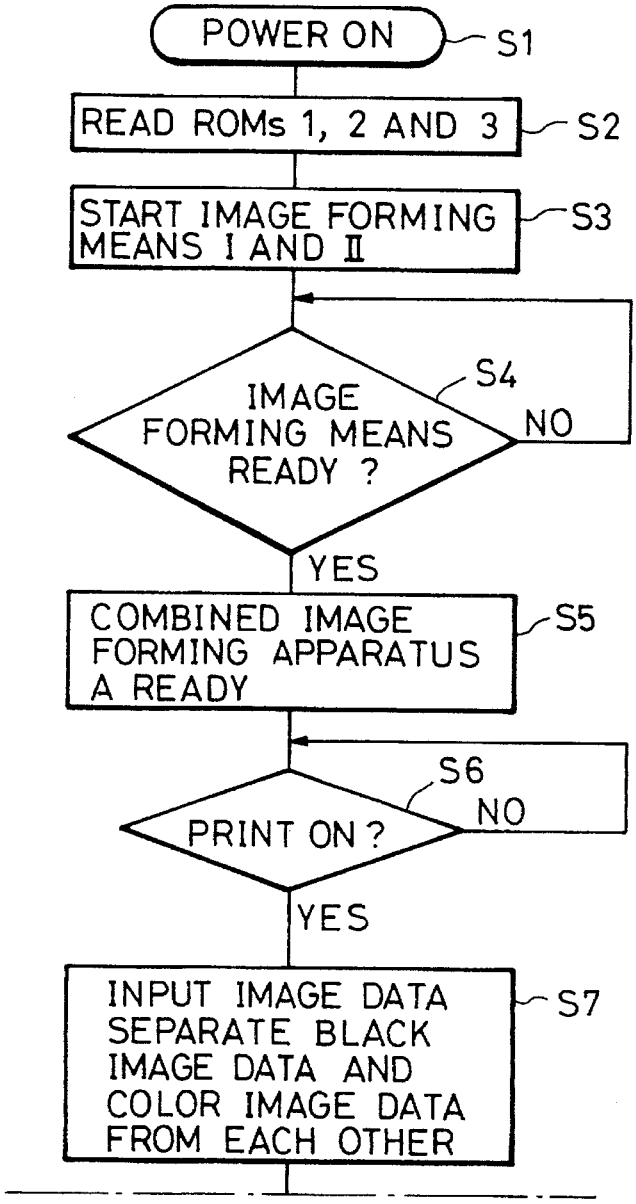
FIG. 4, which is comprised of FIGS. 4A and 4B, is a flow chart of the operation according to the first embodiment of the present invention.
Figure 4B:
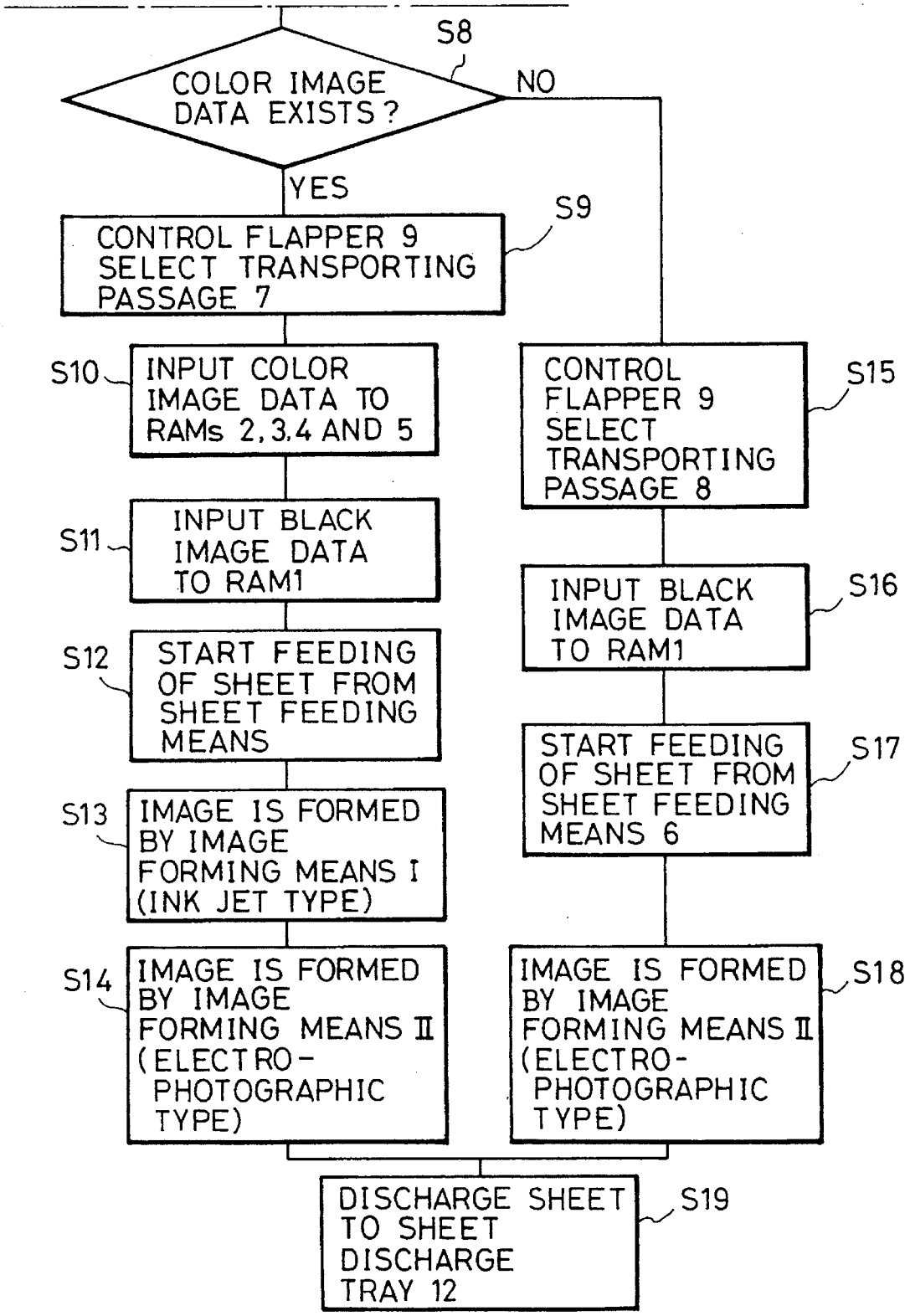

The operation of the combined-type image forming apparatus A having the foregoing structure according to the first embodiment will now be described with reference to FIGS. 4A and 4B (which are flow charts of the operation according to the first embodiment).

The operation of the first embodiment is divided in the two cases below:

(1) a case where image data supplied to the combined-type image forming apparatus A is data which is mixture of black/color image data, in which the combined-type image forming apparatus is basically operated similarly to the conventional apparatus; and (2) a case where only black image data has been supplied to the combined-type image forming apparatus A, which is an essential portion of the present invention.

Each operation will now be described.

(1) The case where image data supplied to the combined-type image forming apparatus A is data which is mixture of black/color image data.

An assumption is performed here that the external apparatus 33, such as a computer, connected to the combined-type image forming apparatus has been turned on. When electric power has been supplied to the combined-type image forming apparatus A (when the combined-type image forming apparatus A has been turned on), the low-voltage power source 3 supplies driving electric power to a CPU 34 (shown in FIG. 2) of the controller 1 so that the combined-type image forming apparatus A is turned on (step S1).

When the CPU 34 starts operation, the contents of a ROM1 (having reference numeral 35 shown in FIG. 2), a ROM2 (having reference numeral 36 shown in FIG. 2) and a ROM3 (having reference numeral 37 shown in FIG. 2) are read, and the read contents are stored in a RAM6 (having reference numeral 38 shown in FIG. 2) (step S2). Thus, the combined-type image forming apparatus A is brought into a ready state in which printing can be performed (step S3). The ROM1 (having reference numeral 35 shown in FIG. 2) stores a portion of the operation sequence of the combined-type image forming apparatus A, the ROM2 stores the operation sequence of the image forming means I and the ROM3 stores the operation sequence of the image forming means II.

RAM6, which reads the contents of ROM1 to ROM3, serves as a working area for the CPU 34. After electric power has been supplied to the combined-type image forming apparatus A and thus the CPU 34 has read the contents of ROM1 to ROM3, the CPU 37 turns on the image forming means I and the image forming means II in accordance with the read sequences (step S4) so that the combined-type image forming apparatus A is brought into a ready state (step S5).

When a printing signal has been supplied from the external apparatus 33, such as a computer (having reference numeral 33 shown in FIG. 2) (step S6), the CPU 34, through an image separation circuit 39, transfers the supplied image data to a RAM1 (having reference numeral 40 shown in FIG. 2), a RAM2 (having reference numeral 41 shown in FIG. 2), a RAM3 (having reference numeral 42 shown in FIG. 2), a RAM4 (having reference numeral 43 shown in FIG. 2) and a RAM5 (having reference numeral 44 shown in FIG. 2). The image separation circuit 39 separates the supplied image data into white and black text data, black graphic image data and color image data (step S7).

Then, selection of transporting path, which is an essential portion of the present invention, is performed (step S8). The process of selecting the transporting path is effected by a selector 11. If color image data is included in the result of the separation, a command is issued to a flapper control circuit 10 so that the flapper 9 is moved to position X (indicated by a continuous line shown in FIG. 1). Thus, the sheet transporting path 7 is selected (step S9).

If only black image data exists in the result of the separation, a command is issued to the flapper control circuit 10 so that the flapper 9 is moved to position Y (indicated by a dashed line shown in FIG. 1). Thus, the sheet transporting path 8 is selected (step S15).

In the case of the operation (1), since the supplied image data is a mixture of black image data and color image data, that is, color image data exists, the sheet transporting path 7 is selected. Then, the CPU 34 supplies the separated image data to RAM2 to RAM5 (step S10) in such a manner that yellow (Y) data is supplied to the RAM2, magenta (M) data is supplied to the RAM3, cyan (C) data is supplied to the RAM4 and black (BK) data is supplied to the RAM5. After the color image data has been supplied to the RAMs, white and black text data/white and black graphic image data is supplied to the RAM1 (step S11). After all image data has been supplied to the RAMs, the CPU 34 causes the recording sheet P to be fed from the sheet-feeding means 6 (step S12) and controls the control circuit 4 and the power supply circuit 2*a* for the image forming means I so that a color image is formed on the recording sheet P (step S13).

The color image is formed by the foregoing ink jet image forming method. The recording sheet P having the thus-formed color image is incrementally transported to the pair of resist rollers 28*a* and 28*b* along the transporting guide 20. Since the pair of the resist rollers 28*a* and 28*b* are not rotated until the recording sheet P is discharged from the pair of the discharge rollers 19*a* and 19*b*, the recording sheet P forms loop L on the transporting guide 20 as indicated by a dashed line shown in FIG. 1.

After the recording sheet P has been discharged from the image forming means I, the CPU 34 controls the control circuit 5 and the power supply circuit 2*b* for the image forming means II so as to form white and black text image/white and black graphic image by a continuous operation (step S14). The white and black text image/white and black graphic image is formed by the foregoing electrophotographic image forming method. As described above, a color image is formed by the ink jet image forming method with a low cost and a white and black text image/white and black graphic image is formed precisely to have an excellent quality by the electrophotographic image forming method. The recording sheet P is discharged to the sheet discharge tray 12 while being faced downwards (step S19). Thus, the operation according to the first embodiment enables an output of a mixture of a black image and a color image to be obtained. (2) The case where only black image data has been supplied to the combined-type image forming apparatus A The operation according to the first embodiment, which is the essential portion of the present invention, will now be described.

The same processes as those to be performed in the case (1) are omitted from the description. When black image data has been supplied to the combined-type image forming apparatus A, that is, if a discrimination is performed in step S8 and no color-image data exists, the CPU 34 supplies black image data to the RAM1 (step S16) and controls the transporting path selection means 11 so that the sheet transporting path 8 is selected (step S15). The foregoing sequential operations are the same as those described in the case of (1). After all image data has been supplied to the RAM1, the CPU 34 causes the recording sheet P to be fed from the sheet-feeding means 6 (step S17). Then, since the flapper control circuit 10 has caused the flapper 9 to be moved to the position Y shown in FIG. 1, the recording sheet P is continuously transported through sheet transporting path 8 to the pair of the resist rollers 28*a* and 28*b* of the image forming means II by a pair of transporting rollers 45*a* and 46*b*. That is, in the present invention, if only black image data is supplied to the combined-type image forming apparatus A, the recording sheet P can be directly transported to the image forming means II for forming a white and black image without passing through the image forming means I for forming a color image.

When the recording sheet P is transported to the pair of the resist rollers 28*a* and 28*b*, the CPU 34, as described above, controls the control circuit 5 and the power supply circuit 2*b* for the image forming means II to form a black image on the recording sheet P by the sequential operation (step S18). Then, the recording sheet P having the formed image is output while being faced downwards (step S19).

If only black image data is supplied to the combined-type image forming apparatus A, this embodiment enables the recording sheet P to be directly transported to the black image forming means without passing through the color image forming means. As a result, undesired wear and tear of the elements of the color image forming means can be prevented.

Second Embodiment

Figure 5:
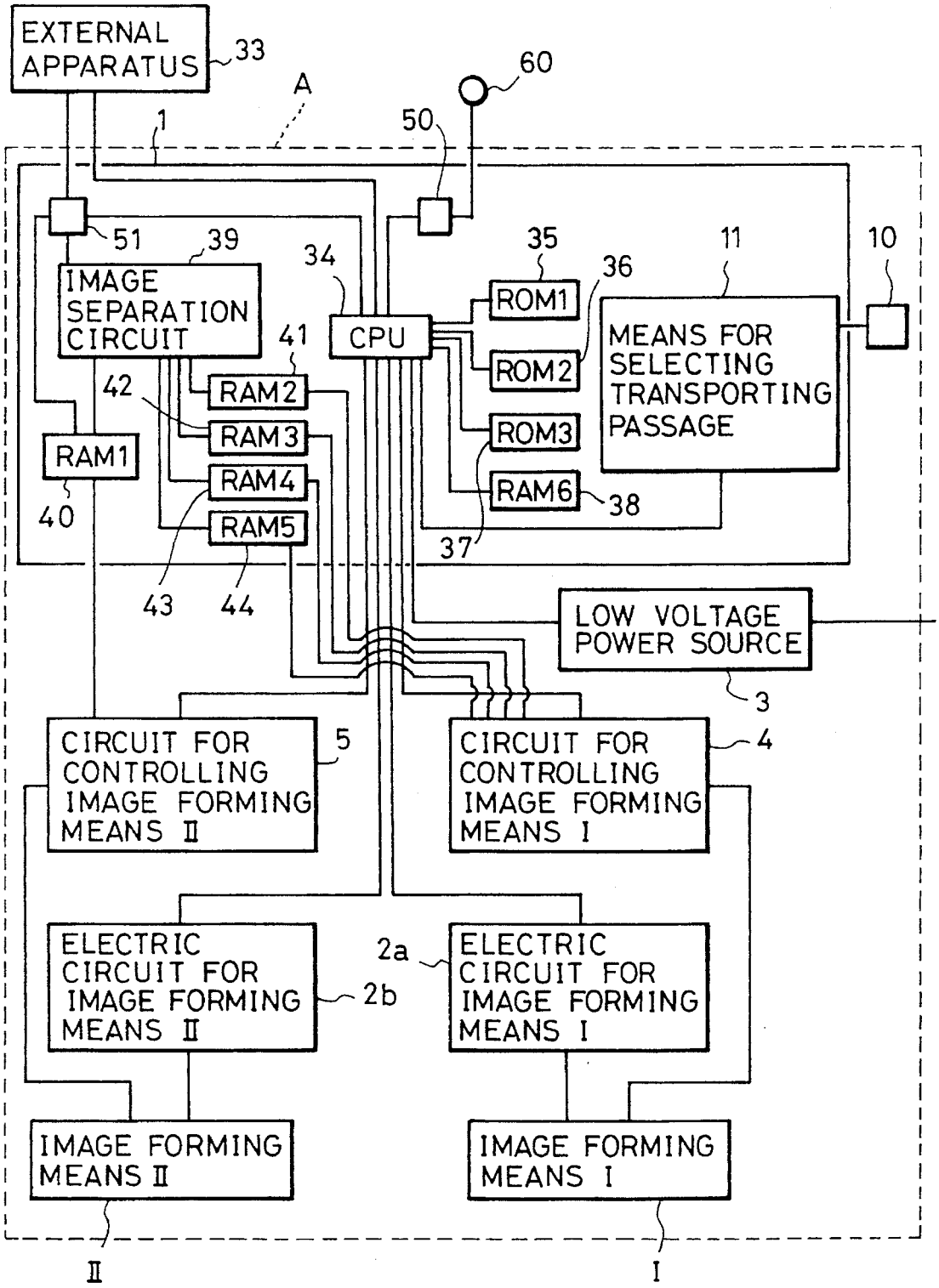
FIG. 5 is a schematic view showing a controller according to a second embodiment of the present invention.

A second embodiment of the present invention has a forcible mode for forcibly selecting the sheet transporting path 8. To form the foregoing structure, the second embodiment has an arrangement such that the controller 1 according to the first embodiment comprises a forcible mode selection means 50 and an image data conversion means 51, as shown in FIG. 5. If a user desires only a black image to be output from the combined-type image forming apparatus, the user is required to depress a switch 60 so that a forcible mode signal is supplied to the CPU 34. When the CPU 34 receives the forcible mode signal, the CPU 34 performs the two operations below. The first operation is an operation in which the CPU 34 issues a command to the transporting path selection means 11 to operate the flapper control circuit 10 so that the flapper 9 is moved to the position Y shown in FIG. 1 (indicated by the dashed line) in order to select the sheet transporting path 8. The second operation is an operation in which the CPU 34 issues a command to the image data conversion means 51 to convert all image data supplied to the combined-type image forming apparatus into black image data. The CPU 34 causes the image data conversion means 51 to supply the converted image data to the RAM1. As a matter of course, the forcible mode signal to be supplied to the CPU 34 may be a signal supplied from the external apparatus 33 in place of the signal supplied from the forcible mode selection means 50. That is, the forcible mode may be selected by the external apparatus 33.

Figures 6, 6A:
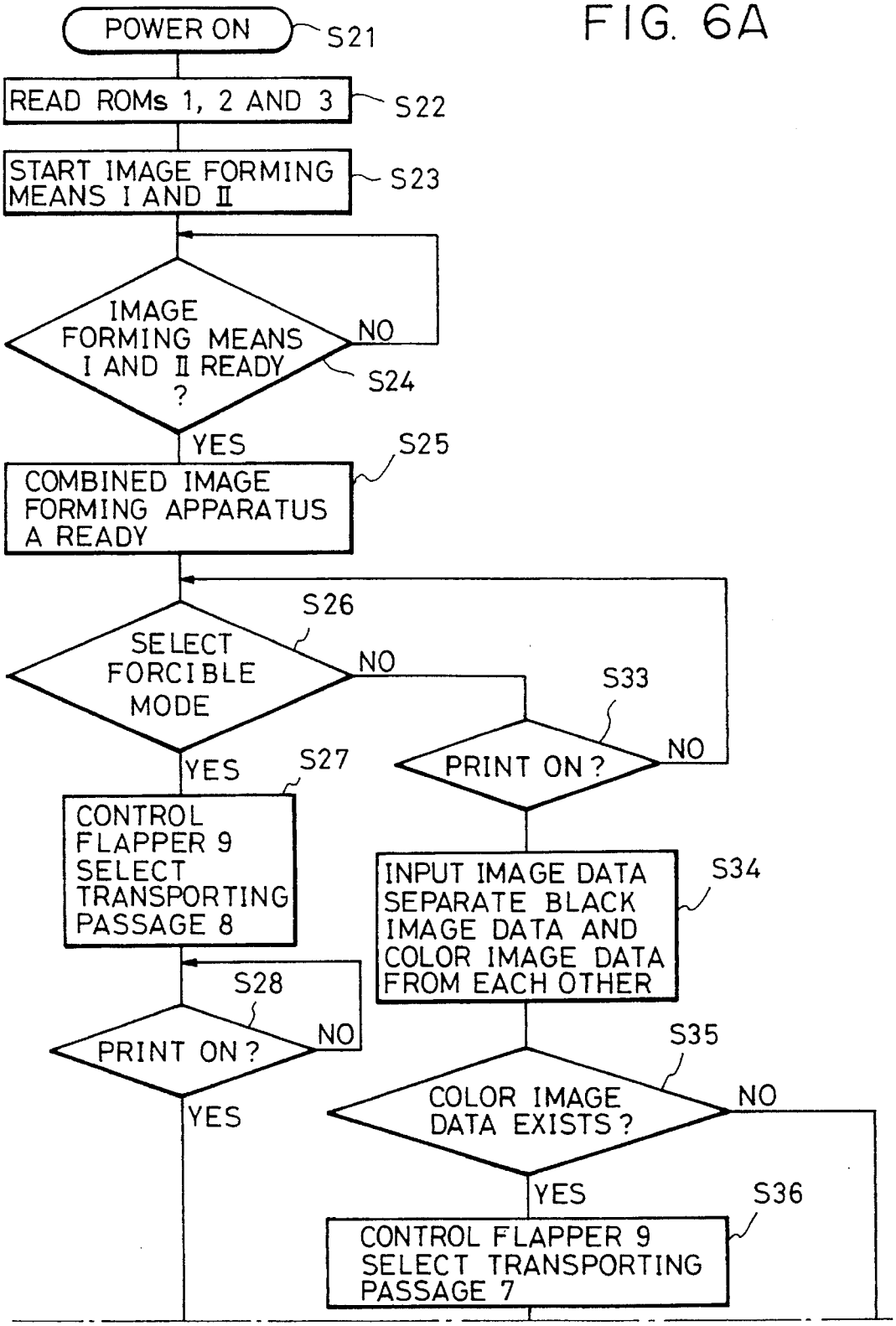
FIG. 6, which is comprised of FIGS. 6A and 6B, is a flow chart of the operation according to the second embodiment of the present invention.
Figure 6B:
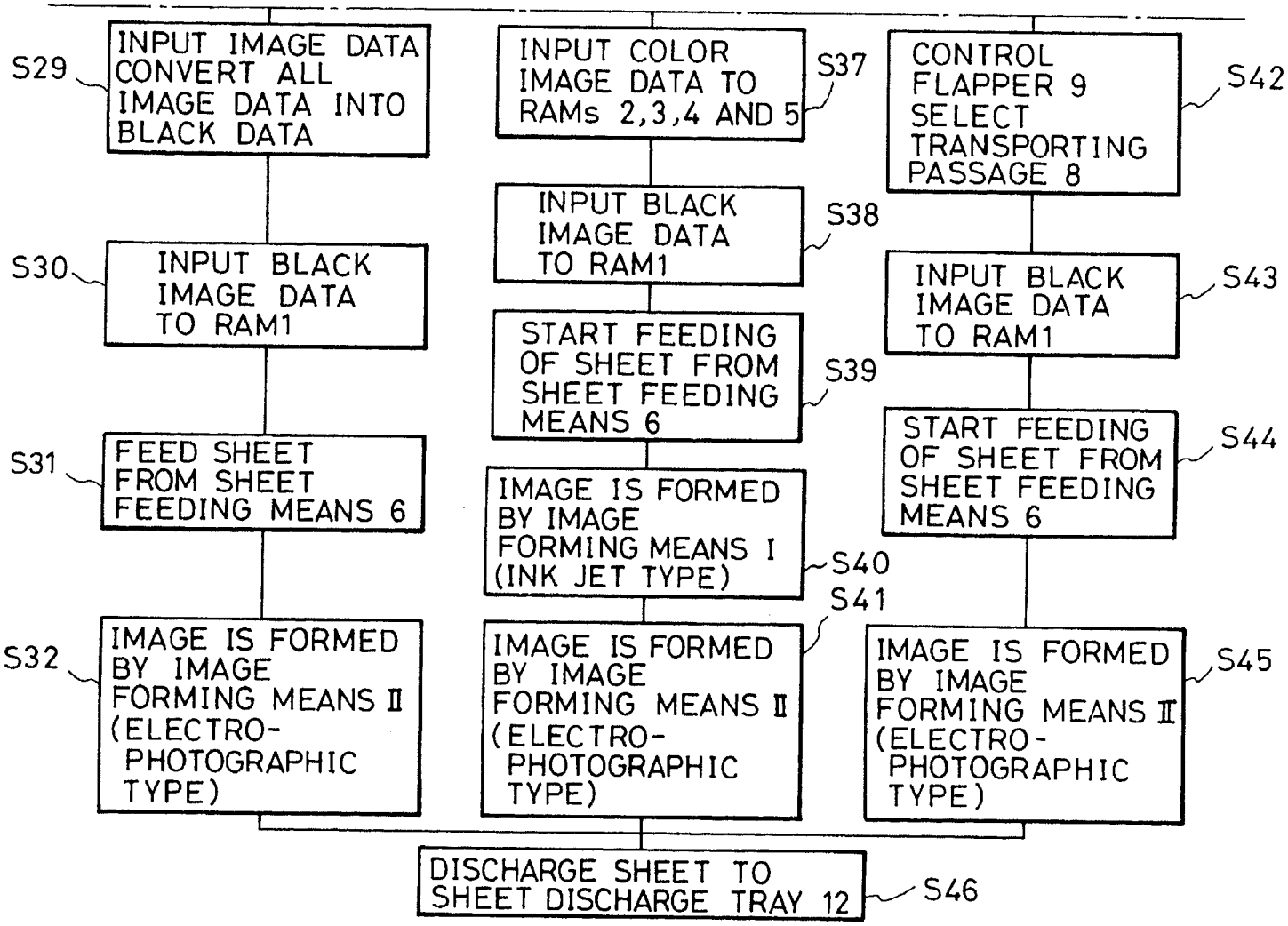

The essential portion of the operation according to the second embodiment will now be described with reference to a flow chart shown in FIG. 6, which is comprised of FIGS. 6A and 6B. If the forcible mode is not selected, the same operation as that according to the first embodiment is performed and that operation is omitted from further description. That is, if the forcible mode is not selected, the operation proceeds from step S21 to step S25, and then a discrimination is performed in step S26 that the forcible selection is not performed. Then, the operation proceeds from step S33 to S35, and if color image data exists the operation proceeds to steps S36 through S41 and S46, or if no color image data exists the operation proceeds to steps S42 through S46. Since the foregoing operations are the same as steps S1 to S19 according to the first embodiment shown in FIG. 4, they are omitted from further description.

Similarly to the first embodiment, the combined-type image forming apparatus is turned on. If a user desires that all image data items are to be formed as a black image, the user depresses a forcible mode switch 60 (see FIG. 5) of a forcible mode setting member to select the forcible mode (step S26). Then, the forcible mode selection means 50 supplies the forcible mode signal to the CPU 34 as described above. Then, the CPU 34 operates the flapper 9 to select the sheet transporting path 8 as described above (step S27).

Then, when a printing signal and mixture image data of a color image and a white and black image are supplied from the external apparatus 33, the CPU 34 operates the image data conversion means 51 to convert all image data into black image data (step S29). Then, the CPU 34 supplies all of the converted image data items (white and black image data) to the RAM1 (step S30). After data input has been completed, the CPU 34 causes the recording sheet P to be fed from the sheet-feeding means 6 (step S31), the recording sheet P being then allowed to pass through the sheet transporting path 8. Thus, the recording sheet P is continuously transported to the image forming means II so that a black image is formed by the electrophotographic image forming method (step S32). Then, the recording sheet P is discharged to the sheet discharge tray 12 while being faced downwards (step S46). As a result, to meet the desire of a user, the color image forming means is not operated but all image data is supplied to only the black image forming means so as to be formed into a black image.

As described above, according to the embodiments of the present invention, there is provided the combined-type image forming apparatus having the plurality of image forming means, the combined-type image forming apparatus comprising: the feeding means for feeding a recording sheet; the first transporting path for directly transporting the recording sheet fed from the feeding means to the first image forming means among the plurality of the image forming means; the second transporting path for transporting the recording sheet supplied from the feeding means to the first image forming means through the second image forming means among the plurality of the image forming means; the transporting path selection means for selecting the first transporting path or the second transporting path; the selection-operation control means for controlling the operation of the transporting path selection means; and the operation control means for controlling the operation of each of the foregoing means, wherein the operation control means has the data separation means for separating the image data supplied to the combined-type image forming apparatus into at least two types of data, that is, first data and second data, in accordance with the attribute of colors; the data discrimination means for discriminating whether or not data separated by the data separation means includes the second data; the means for causing the selection-operation control means to operate the transporting path selection means to select the second transporting path if the data discrimination means has discriminated that the second data is included; the means which causes the recording sheet to be supplied from the feeding means to the first image forming means through the second image forming means to cause the second image forming means and the first image forming means to form an image after the transporting path selection means has selected the second transporting path; the means for causing the selection-operation control means to operate the transporting path selection means to select the first transporting path if the data discrimination means has discriminated that the second data is not included; and the means for directly feeding the recording sheet from the feeding means to the first image forming means and causing the first image forming means to form an image after the transporting path selection means has selected the first transporting path.

Furthermore, the operation control means further comprises the mode discrimination means for discriminating whether or not the forcible mode is selected before the data discrimination means discriminates the attribute of the color to select the first transporting path if the mode discrimination means has discriminated that the forcible selection is performed and operates the data discrimination means if the mode discrimination means has discriminated that the forcible mode selection is not performed.

Other Embodiments

Although the foregoing embodiments include the plurality of the image forming means in accordance with the different image forming methods consisting of the electrophotographic image forming method and the ink jet image forming method, the present invention is not limited to the foregoing recording methods. For example, a heat sensitive recording method or a thermal transfer recording method may be employed in the present invention.

The individual components shown in outline or designated by blocks in the drawings are all well-known in the image recording arts and their specific construction and operation are not critical to the operation or best mode for carrying out the invention.

Although the invention has been described in its preferred form with a certain degree of particularity, it is understood that the present disclosure of the preferred form can be changed in the details of construction and the combination and arrangement of parts may be changed without departing from the spirit and the scope of the invention as hereinafter claimed.

What is claimed is:

1. An image forming apparatus for forming an image on a recording medium, said apparatus comprising:

a first transporting path for transporting the recording medium for forming an image with first image forming means using a first image forming method;

a second transporting path for transporting the recording medium for forming an image with second image forming means using a second image forming method which is different from the first image forming method; and control means for controlling said apparatus in at least one of a black image selection mode, in which the first transporting path is selected in accordance with black image data for forming a black image on the recording medium, and the recording medium is transported through said first transporting path to form a black image on the recording medium, a color image selection mode, in which the second transporting path is selected in accordance with image data including color image data for forming a color image on the recording medium and the recording medium is transported through said second transporting path to form a color image on the recording medium, and a forcible selection mode in which the first transporting path is selected even if the image data includes color image data to transport the recording medium through said first transporting path to form a black image on the recording medium.

2. An image forming apparatus according to claim 1, further comprising a forcible mode setting member for causing said control means to effect the forcible selection mode.

3. An image forming apparatus according to claim 2, wherein said forcible mode setting member comprises a forcible mode switch and the forcible selection mode is selected when said forcible mode switch is depressed.

4. An image forming apparatus according to claim 1 or claim 2, further comprising means for discriminating supplied image data wherein the black image selection mode or the color image selection mode of said control means is automatically set in accordance with a discrimination by said discriminating means that black image data or color image data has been supplied.

5. An image forming apparatus according to claim 4, wherein the color image data includes one of color data and both color data and black data.

6. An image forming apparatus according to claim 1, wherein said control means comprises data separation means for separating supplied image data into first data and second data in accordance with color data, data discrimination means for discriminating whether or not the second data exists in the data separated by said data separation means and selection means for selecting the second transporting path if said data discrimination means has discriminated that the second data exists.

7. An image forming apparatus according to claim 6, wherein the second data comprises the image data including color image data.

8. An image forming apparatus according to claim 1 or claim 7, wherein said control means controls the recording medium to be transported through said first transporting path after passing through said second transporting path if the color selection mode has been selected.

9. An image forming apparatus according to claim 8, wherein the first image forming method comprises an electrophotographic image forming method with which a black toner image is formed on an electrophotographic photosensitive member and the toner image is transferred to the recording medium to form an image on the recording medium.

10. An image forming apparatus according to claim 8, wherein the second image forming method comprises an ink jet image forming method with which liquid ink is discharged through a nozzle to form an image on the recording medium.

11. An image forming apparatus according to claim 10, wherein said nozzle comprises a first nozzle for discharging yellow liquid ink, a second nozzle for discharging magenta liquid ink and a third nozzle for discharging cyan liquid ink.

12. An image forming apparatus according to claim 10, wherein the ink jet image forming method employs an electro-thermal converter for generating heat energy for discharging the liquid ink.

13. An image forming apparatus according to claim 12, wherein the ink jet image forming method comprises generating film boiling in the liquid ink due to heat energy supplied by said electro-thermal converter to discharge the liquid ink through said nozzle.

14. An image forming apparatus for forming an image on a recording medium, said apparatus comprising:

electrophotographic image forming means for forming an image on the recording medium in accordance with an electrophotographic image forming method, said electrophotographic image forming means forming a toner image on an electrophotographic photosensitive member and transferring the toner image to the recording medium to form the image on the recording medium;

ink jet image forming means for forming an image on the recording medium in accordance with an ink jet image forming method, said ink jet image forming means forming the image on the recording medium by causing a nozzle to discharge liquid ink;

a first transporting path for transporting the recording medium for forming the image on the recording medium by using said electrophotographic image forming means;

a second transporting path for transporting the recording medium for forming the image on the recording medium by using said ink jet image forming means;

control means for controlling said apparatus in at least one of a black image selection mode, in which the first transporting path is selected in accordance with black image data for forming a black image on the recording medium, and the recording medium is transported through said first transporting path to form a black image on the recording medium, a color image selection mode, in which the second transporting path is selected in accordance with image data including color image data for forming a color image on the recording medium and the recording medium is transported through said second transporting path to form a color image on the recording medium, and a forcible selection mode in which the first transporting path is selected even if the image data includes color image data to transport the recording medium through said first transporting path to form a black image on the recording medium; and setting means for automatically setting at least one of the black image selection mode and the color image selection mode in accordance with a result of discrimination as to whether supplied image data includes black image data or color image data, and setting the forcible selection mode when a forcible mode setting member is operated.

15. An image forming apparatus according to claim 14, wherein said forcible mode setting member comprises a forcible mode switch and the forcible selection mode is selected when said forcible mode switch is depressed.

16. An image forming apparatus according to claim 14, wherein the color image data includes one of color data and both color data and black data.

17. An image forming apparatus according to claim 14, wherein said control means comprises data separation means for separating the supplied image data into color image data and black image data in accordance with color data, data discrimination means for discriminating whether or not the color image data exists in the data separated by said data separation means and selection means for selecting the second transporting path if said data discrimination means has discriminated that color image data exists.

18. An image forming apparatus according to claim 14, wherein said control means controls the recording medium to be transported through said first transporting path after passing through said second transporting path if the color selection mode has been selected.

19. An image forming apparatus according to claim 14, wherein said nozzle of said ink jet image forming means comprises a first nozzle for discharging yellow liquid ink, a second nozzle for discharging magenta liquid ink and a third nozzle for discharging cyan liquid ink.

20. An image forming apparatus according to claim 14, wherein said ink jet image forming means comprises an electro-thermal converter for generating heat energy for discharging the liquid ink.

21. An image forming apparatus according to claim 20, wherein said electro-thermal converter of said ink jet image forming means generates film boiling in the liquid ink due to heat energy to discharge the liquid ink through said nozzle.

22. An image forming apparatus for forming black images and color images on a recording medium, said image forming apparatus comprising:

electrophotographic image forming means for forming an image on the recording medium in accordance with an electrophotographic image forming method, said electrophotographic image forming means forming a toner image on an electrophotographic photosensitive member and transferring the toner image to the recording medium to form the image on the recording medium;

ink jet image forming means for forming an image on the recording medium in accordance with an ink jet image forming method, said ink jet image forming means forming the image on the recording medium by causing a nozzle to discharge liquid ink;

a first transporting path for transporting the recording medium for forming the image on the recording medium by using said electrophotographic image forming means;

a second transporting path for transporting the recording medium for forming the image on the recording medium by using said ink jet image forming means;

control means for controlling said apparatus in at least one of a black image selection mode, in which the first transporting path is selected in accordance with black image data for forming a black image on the recording medium, and the recording medium is transported through said first transporting path to form a black image on the recording medium, a color image selection mode, in which the second transporting path is selected in accordance with image data including color image data for forming a color image on the recording medium and the recording medium is transported through said second transporting path and then transported through the first transporting path to form a color image on the recording medium, and a forcible selection mode in which the first transporting path is selected even if the image data includes color image data to transport the recording medium through said first transporting path to form a black image on the recording medium, data separation means for separating supplied image data into color image data and black image data;

data discrimination means for discriminating whether or not color image data exists in the data separated by said data separation means; and setting means for automatically setting the black image selection mode and the color image selection mode in said control means in accordance with a result of said discrimination means as to whether the supplied image data includes black image data or color image data, and setting the forcible selection mode in said control means when a forcible mode setting member is operated.

23. An image forming apparatus according to claim 22, wherein said forcible mode setting member comprises a forcible mode switch and the forcible selection mode is selected when said forcible mode switch is depressed.

24. An image forming apparatus according to claim 22, wherein the color image data includes one of color data and both color data and black data.

25. An image forming apparatus according to claim 22, wherein said control means selects the second transporting path if said data discrimination means has discriminated that color image data exists.

26. An image forming apparatus according to claim 22, wherein said nozzle of said ink jet image forming means comprises a first nozzle for discharging yellow liquid ink, a second nozzle for discharging magenta liquid ink and a third nozzle for discharging cyan liquid ink.

27. An image forming apparatus according to claim 22, wherein said ink jet image forming means comprises an electro-thermal converter for generating heat energy for discharging the liquid ink.

28. An image forming apparatus according to claim 27, wherein said electro-thermal converter of said ink jet image forming means generates film boiling in the liquid ink due to heat energy to discharge the liquid ink through said nozzle.

29. An image forming apparatus for forming an image on a recording medium, said apparatus comprising:

first image forming means for forming an image on the recording medium in accordance with a first image forming method;

second image forming means for forming an image on the recording medium in accordance with a second image forming method;

control means for controlling an image to be formed on the recording medium by said first image forming means when input image data is of a first type, controlling an image to be formed on the recording medium by said second image forming means when input image data is of a second type, and controlling an image to be formed on the recording medium by said first and second image forming means when input image data is of a mixed type including the first and second type; and override means for selectively causing said control means to control an image to be formed by said first image forming means regardless of whether the input image data is of the first, second or mixed type.

30. An image forming apparatus according to claim 29, wherein image data of the first type comprises black and white image data and image data of the second type comprises color image data.

31. An image forming apparatus according to claim 29, wherein the first image forming means comprises an electrophotographic printer.

32. An image forming apparatus according to claim 29, wherein the second image forming means comprises a color ink jet printer.

33. A method of forming an image on a recording medium, said method comprising the steps of:

providing a first image forming device for forming an image on the recording medium according to a first image forming method and a second image forming device for forming an image on the recording medium according to a second image forming method;

controlling an image to be formed on the recording medium by the first image forming device when input image data is of a first type, controlling an image to be formed on the recording medium by the second image forming device when input image data is of a second type, and controlling an image to be formed on the recording medium by the first and second image forming devices when input image data is of a mixed type including the first and second types; and selectively causing an image to be formed by the first image forming device regardless of whether the input image data is of the first, second or mixed type.

34. An image forming method according to claim 33, wherein image data of the first type comprises black and white image data and image data of the second type comprises color image data.

35. An image forming method according to claim 33, wherein the first image forming device comprises an electrophotographic printer.

36. An image forming method according to claim 33, wherein the second image forming device comprises a color ink jet printer.

* * * * *